US007088283B2

(12) United States Patent
Kobayashi

(10) Patent No.: US 7,088,283 B2
(45) Date of Patent: Aug. 8, 2006

(54) PLAYER WITH A REMOTE CONTROLLER, REMOTE CONTROLLER AND PLAYER

(75) Inventor: Hiroshi Kobayashi, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 489 days.

(21) Appl. No.: 10/142,956

(22) Filed: May 13, 2002

(65) Prior Publication Data

US 2003/0020628 A1 Jan. 30, 2003

(30) Foreign Application Priority Data

Jul. 24, 2001 (JP) ..... 2001-223228
Jul. 27, 2001 (JP) ..... 2001-004911

(51) Int. Cl.
*G08C 17/00* (2006.01)

(52) U.S. Cl. ..... 341/176; 340/825.69; 348/734

(58) Field of Classification Search ..... 341/176, 341/340, 825.69, 825.72; 340/825.69, 825.72; 348/734

See application file for complete search history.

(56) References Cited

U.S. PATENT DOCUMENTS 5,005,084 A * 4/1991 Skinner ..... 348/734
5,486,852 A * 1/1996 Arai ..... 348/211.2

FOREIGN PATENT DOCUMENTS

| | | |
|---|---|---|
| JP | 61-273098 | 12/1986 |
| JP | 3-32196 | 2/1991 |
| JP | 6-257838 | 9/1994 |

* cited by examiner

*Primary Examiner*—Wendy R. Garber
*Assistant Examiner*—Hung Q Dang
(74) *Attorney, Agent, or Firm*—Morgan, Lewis & Bockius LLP

(57) ABSTRACT

A remote controller which is associated with a player is configured by a first remote controller and a second remote controller. The first remote controller 100 is a simplified remote controller comprising only operating keys relating to basic functions, such as a power source key 5, a play key 6, a stop key 7, a forward key 8, and a reverse key 9. Because of the small kinds of keys, even a child can easily operate the player. By contrast, the second remote controller is an ordinary remote controller which comprises various keys in addition to the operating keys 5 to 9 of the remote controller 100, thereby enabling complex operations to be performed.

6 Claims, 7 Drawing Sheets

PLAYER WITH A REMOTE CONTROLLER, REMOTE CONTROLLER AND PLAYER

BACKGROUND OF THE INVENTION

The present invention relates to a player with a remote controller which comprises a player and a remote controller that controls the operation of the player.

In a player such as a DVD (Digital Versatile Disk) player, usually, a remote controller is associated with the player, so that the operation of the player can be remotely controlled by the remote controller. Keys corresponding to various functions are disposed in the remote controller. When the keys are operated, signals are transmitted from the remote controller to the player to cause the player to perform various operations.

Such a conventional remote controller is designed on the assumption that it is operated by an adult, and comprises all keys corresponding to various functions of a player. When a child operates a remote controller in order to watch an animated cartoon of a DVD or the like, therefore, the child cannot know the key to be operated because the number of the keys is excessively large.

As disclosed in the Unexamined Japanese Patent Application Publication No. Sho61-273098, a remote controller may be housed in a recess formed in a top plate of a player. In this case, the remote controller must be housed in such a manner that even a child can easily take out the remote controller. In the structure disclosed in the publication, the remote controller is attached by magnets at end positions in the longitudinal direction. Therefore, a large force must be exerted for taking out the remote controller. As a result, a child cannot easily take out the remote controller with one hand.

SUMMARY OF THE INVENTION

The invention is conducted in order to solve the problems. It is an object of the invention to provide a player with a remote controller which can be easily operated even by a child. It is another object of the invention to provide a player with a remote controller in which the remote controller can be easily taken out even by a child from the player.

In the invention, a remote controller which is associated with a player is configured by a first remote controller and a second remote controller. The first remote controller is a simplified remote controller comprising only operating keys relating to basic functions, for example, a power source key, a play key, a stop key, and feed keys. The second remote controller is an ordinary remote controller which comprises keys that are identical with the operating keys of the first remote controller, and various keys.

According to the configuration, when a child wishes to reproduce a DVD or the like, the child can use the first remote controller. Since the first remote controller is provided with the small number of keys relating to the basic functions, even a child can easily perform an operation such as reproduction or stop without being confused by the keys. By contrast, when an adult operates the player, the adult can use the second remote controller so as to exert also the additional functions in addition to the basic functions, with the result that the remote controller can be used as in an original manner as a remote controller.

In the invention, a recess in which the first remote controller is to be housed is formed in a top plate of the player, so that the remote controller can be stored integrally with the player. In a preferred embodiment, the first remote controller comprises an operating portion in which keys are arranged on a surface, and a pair of projected portions which are forward projected with being continuous to the operating portion, the recess of the player is formed into a shape which corresponds to the shapes of the operating portion and the projected portions, and the first remote controller housed in the recess is attached in the pair of projected portions to the player by magnets.

The embodiment has a structure in which the first remote controller is attached to the top plate at the positions of the projected portions which are located on one side. When the operating portion which is on the side opposite to the projected portions is gripped and lifted, therefore, the first remote controller can be easily taken out by the principle of the lever from the recess of the top plate against the attractive force of the magnets.

In order to further facilitate the taking-out operation, it is preferable to set the area of the pair of projected portions to be smaller than that of the operating portion, and also to set the depth of the recess of the top plate to be smaller than the thickness of the first remote controller.

Further, in the invention, a remote controller which is associated with a player is configured by a first remote controller and a second remote controller. The first remote controller is a simplified remote controller comprising only operating keys relating to basic functions, i.e., a power source key, a play key, a stop key, and feed keys. The second remote controller is an ordinary remote controller which comprises keys that are identical with the basic operating keys of the first remote controller, and keys for additional functions, including a menu key, a mode key, and a zoom key.

Still further, in the invention, a recess in which the first remote controller is to be housed is formed in a top plate of the player, so that the remote controller can be stored integrally with the player. In a preferred embodiment, the first remote controller comprises an operating portion in which keys are arranged on a surface, and a pair of projected portions which are forward projected with being continuous to the operating portion, the recess of the player is formed into a shape which corresponds to the shapes of the operating portion and the projected portions, and the first remote controller housed in the recess is magnetically attached to the player by magnets which are disposed in the pair of projected portions, respectively.

DETAILED DESCRIPTION OF THE PREFERRED EMBODIMENTS

Figure 1A:
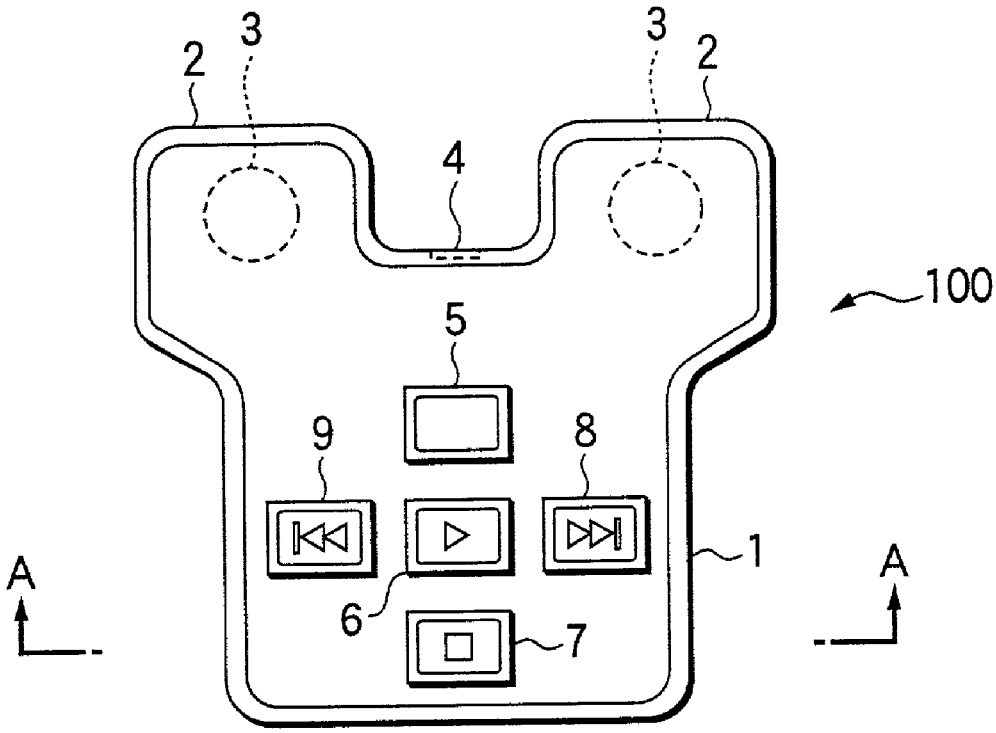
FIGS. 1A and 1B are a plan view and a section view of a first remote controller in the invention.
Figure 1B:
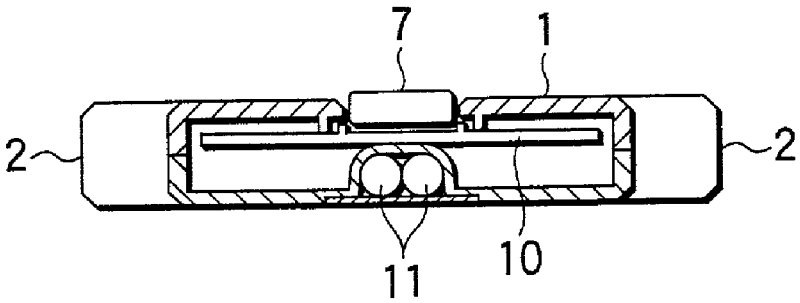
Figure 8:
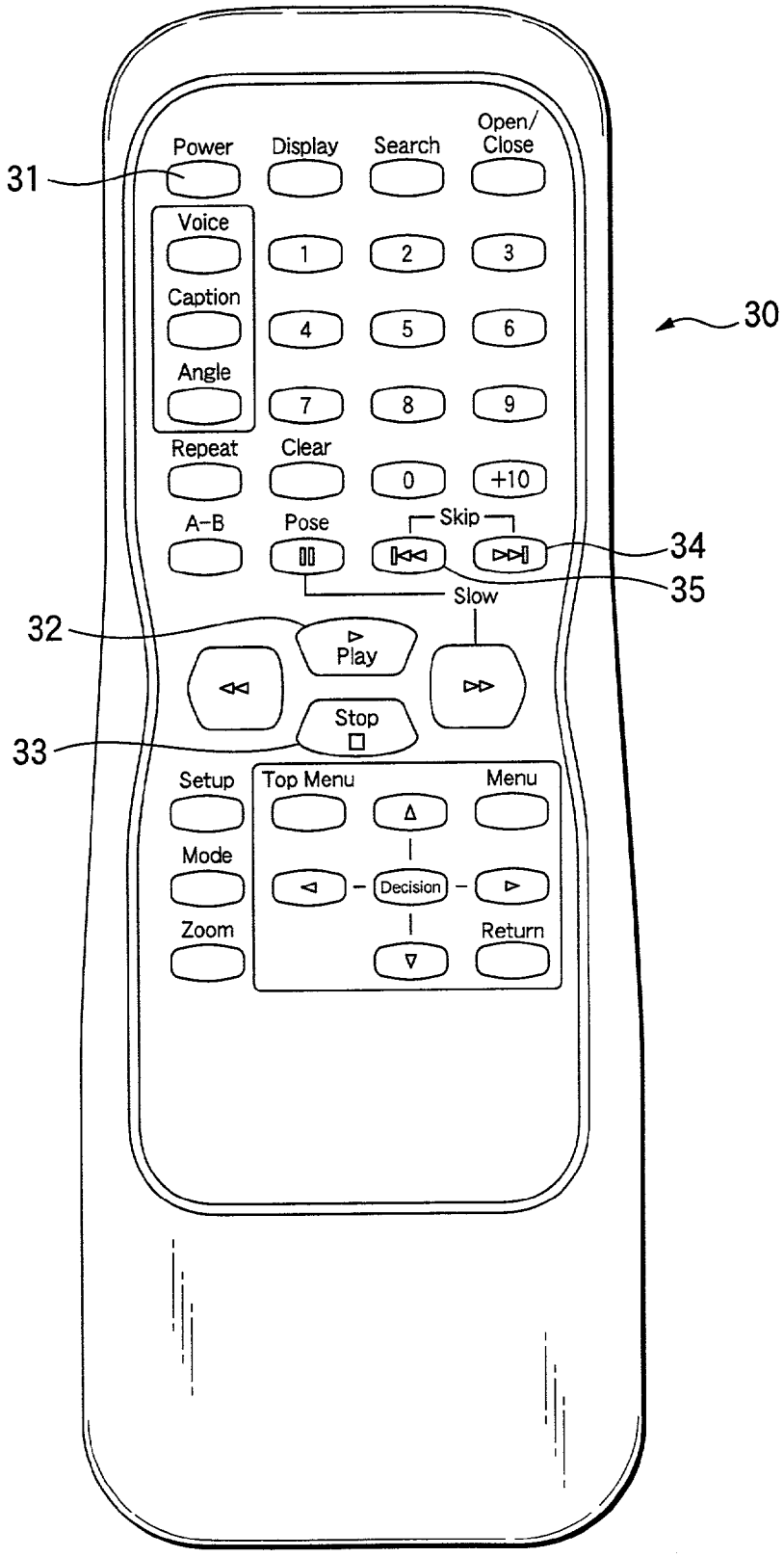
FIG. 8 is a plan view of a second remote controller.

The player with a remote controller of the invention is configured by a player having a function of reproducing a disk such as a DVD, and first and second remote controllers which control the operation of the player. FIG. 1 shows an example of the first remote controller used in the invention. FIG. 1A is a plan view of the first remote controller, and FIG. 1B is a section view taken along the line A—A of FIG. 1A. FIG. 8 is a plan view of an example of the second remote controller used in the invention. In the two remote controllers, the first remote controller 100 is a simplified remote controller for a child which is characteristic of the invention, and the second remote controller 30 is an ordinary remote controller which is conventionally used and can operate additional functions also.

Referring to FIG. 1, the first remote controller 100 is configured by an operating portion 1 in which operating keys 5 to 9 are arranged on the surface, and a pair of projected portions 2 which are forward projected with being continuous to the operating portion 1. The operating portion 1 and the projected portions 2 are integrally formed by a synthetic resin. The area of the projected portions 2 is smaller than that of the operating portion 1. Magnets 3 are fixed to the rear sides of the projected portions 2, respectively. The reference numeral 4 denotes a light emitting portion configured by an IR light emitting diode or the like which transmits a signal to the player. The light emitting portion is positioned between the projected portions 2.

Among the keys disposed in the operating portion 1, the key 5 is a power source key for turning on/off the power source of the player, the key 6 is a play key for reproducing the disk, the key 7 is a stop key for stopping the operation of reproducing the disk, the key 8 is a forward feed key, and the key 9 is a reverse feed key. In the embodiment, the feed keys 8 and 9 are skip keys. Alternatively, the feed keys may be fast-forward and fast-reverse keys. In this way, the remote controller 100 of FIG. 1 is designed on the assumption that it is operated by a child, and provided with only the operating keys 5 to 9 relating to the basic functions such as reproduction and stop as described above. In FIG. 1B, 10 denotes a circuit board disposed inside the remote controller, and 11 denotes batteries for driving the remote controller.

Figure 2A:
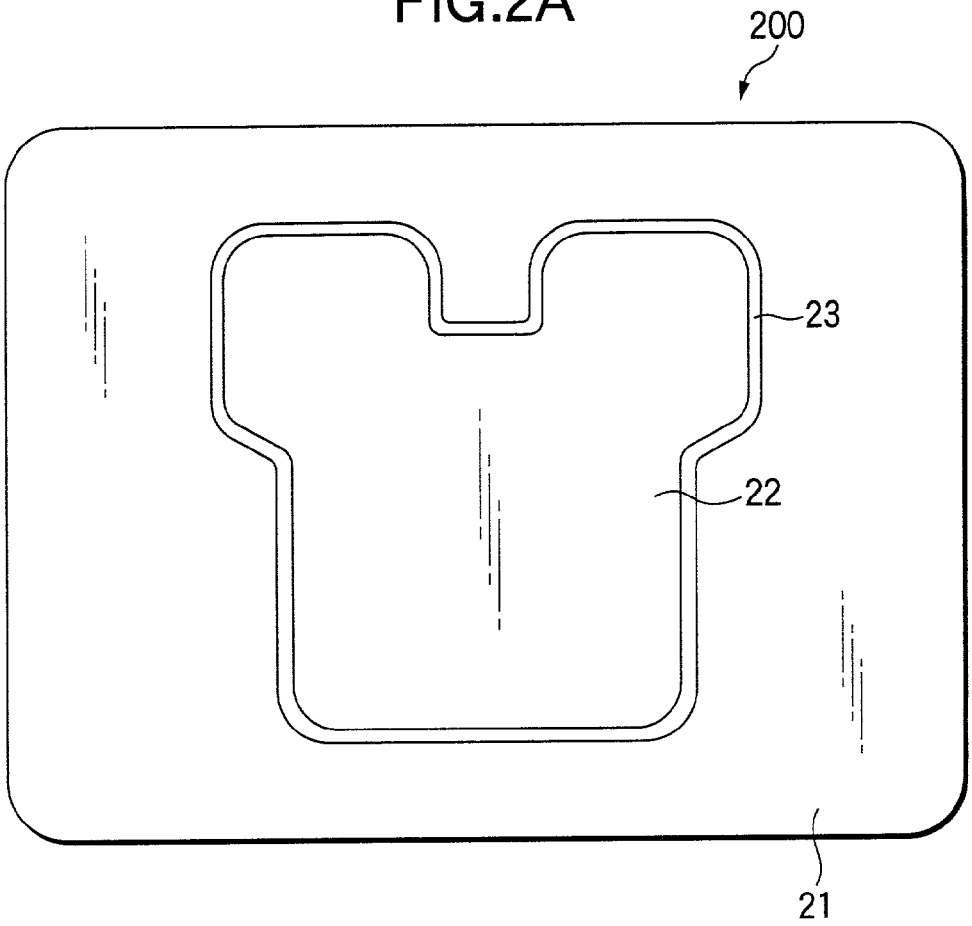
FIGS. 2A and 2B are a plan view and a front view of a player of the invention.
Figure 2B:
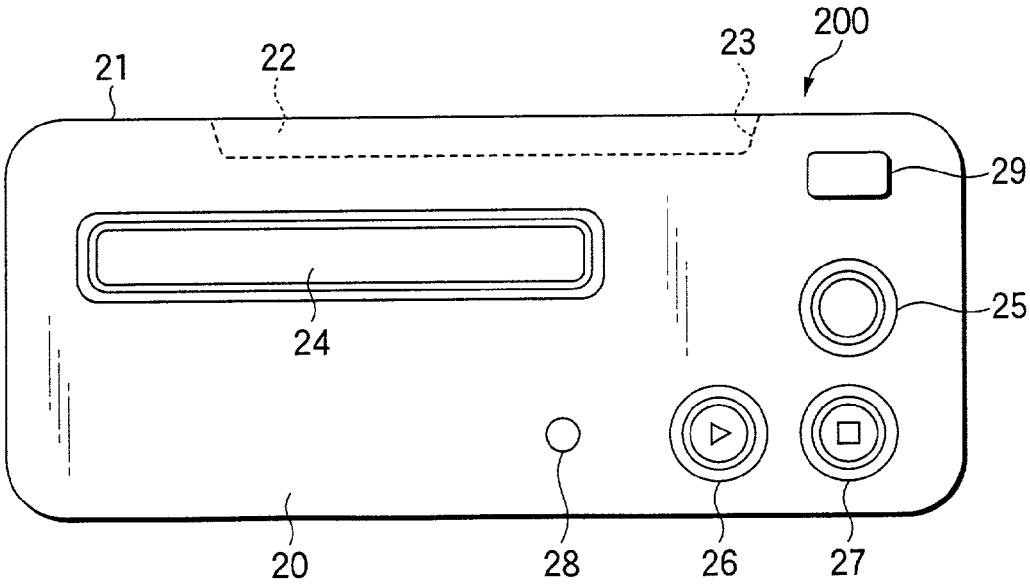

FIG. 2A is a plan view of an example of a DVD player according to the invention, and FIG. 2B is a front view of the player. In the player 200, as shown in FIG. 2A, a recess 22 is formed in a top plate 21 of the upper face. The shape of the recess 22 is identical with that of the combination of the operating portion 1 and the projected portions 2 of the remote controller 100, so that the remote controller 100 can be fittingly housed in the recess 22. The reference numeral 23 denotes a tapered portion which is formed in the peripheral edge of the recess 22. As shown in FIG. 2B, a power source button 25, a play key 26, and a stop button 27 are disposed on a front panel 20 of the player 200, so that minimum operations can be performed on the side of the player without using any remote controller. The reference numeral 24 denotes an insertion slot for a disk, 28 denotes a light receiving portion which receives infrared light from the light emitting portion 4 of the remote controller 100, and 29 denotes an insertion/ejection button which is operated when a disk is inserted into or ejected from the insertion slot 24. The light receiving portion 28 serves as a light receiving portion common to the remote controllers, so that the portion can receive also light from the light emitting portion (not shown in FIG. 8) of the remote controller 30. A case of the player 200 is formed by a metal plate which is made of a ferromagnetic material, and in which the whole surface is coated by a thin resin layer. This configuration is a mere example. The case may be configured by a ferromagnetic metal plate only while omitting the resin layer.

In the thus configured player with a remote controller, when a child wishes to reproduce a DVD, the child operates the player with using the first remote controller 100. As described above, the keys 5 to 9 disposed on the remote controller 100 are the operating keys relating to the basic functions such as reproduction and stop, or the minimum keys required for a child to operate. Therefore, the kinds of the keys are so small in number that even a child can easily perform the basic functions without being confused by the keys. By contrast, when an adult wishes to reproduce a DVD, the adult operates the player with using the second remote controller 30 shown in FIG. 8. The remote controller 30 comprises the various kinds of keys corresponding to the functions, in addition to a power source button 31, a play key 32, a stop button 33, and feed keys 34 and 35 which are similar to those disposed on the first remote controller 100. When the remote controller 30 is used, therefore, it is possible to perform complex operations such as searching, captioning, multiangle display, repeated reproduction, and zooming. It is a matter of course that, in the case where only the basic functions are required, also an adult can use the first remote controller 100. Not only a child but also an aged person who is unfamiliar with an operation of a remote controller can use the first remote controller 100 so as to easily operate the player.

Figure 3A:
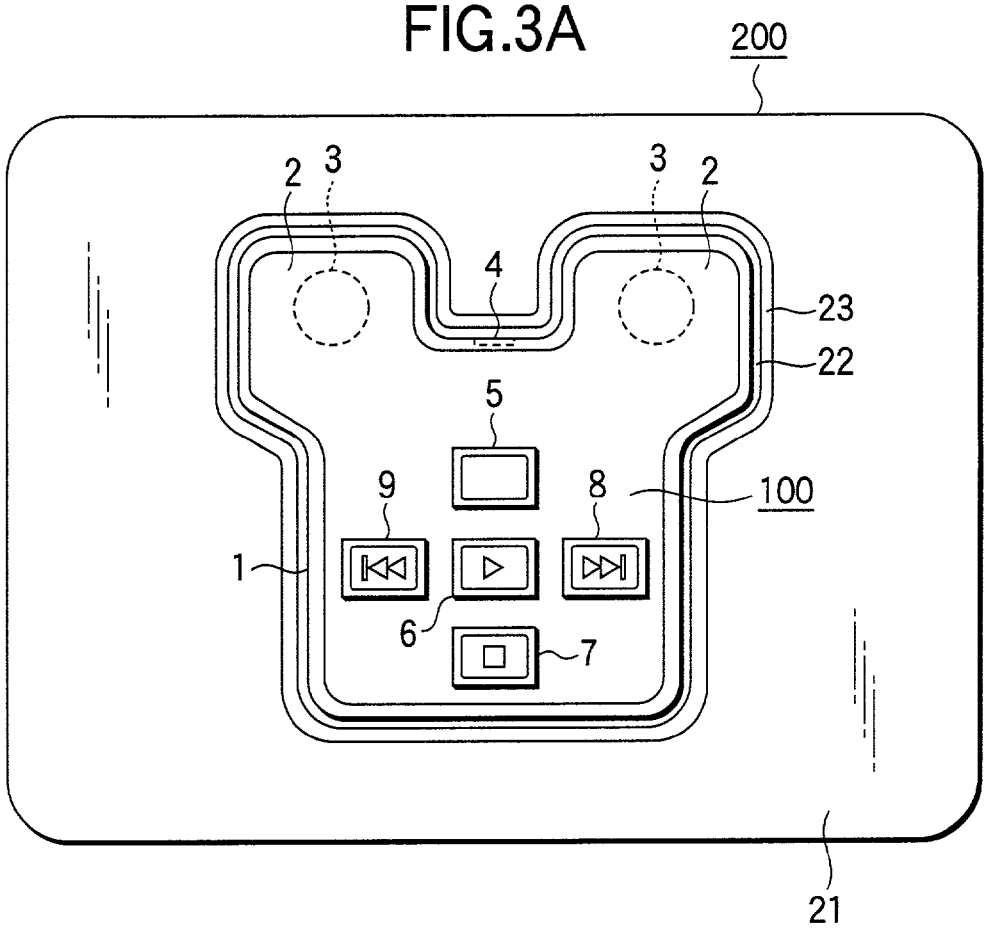
FIGS. 3A and 3B are a plan view and a front view showing a state where the first remote controller is housed in the player.
Figure 3B:
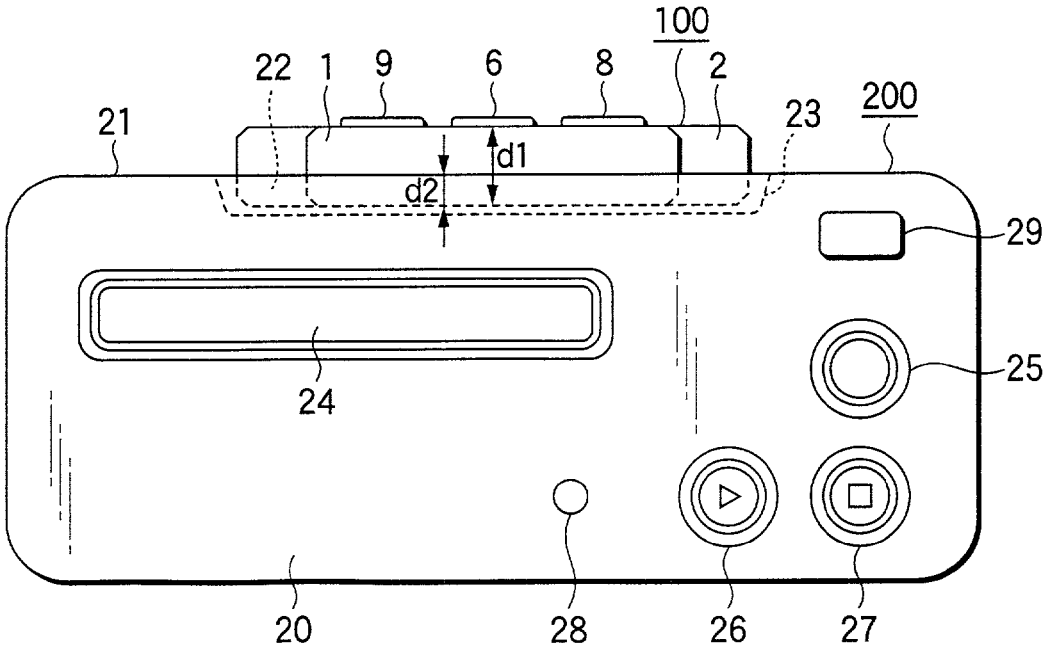
Figure 4:
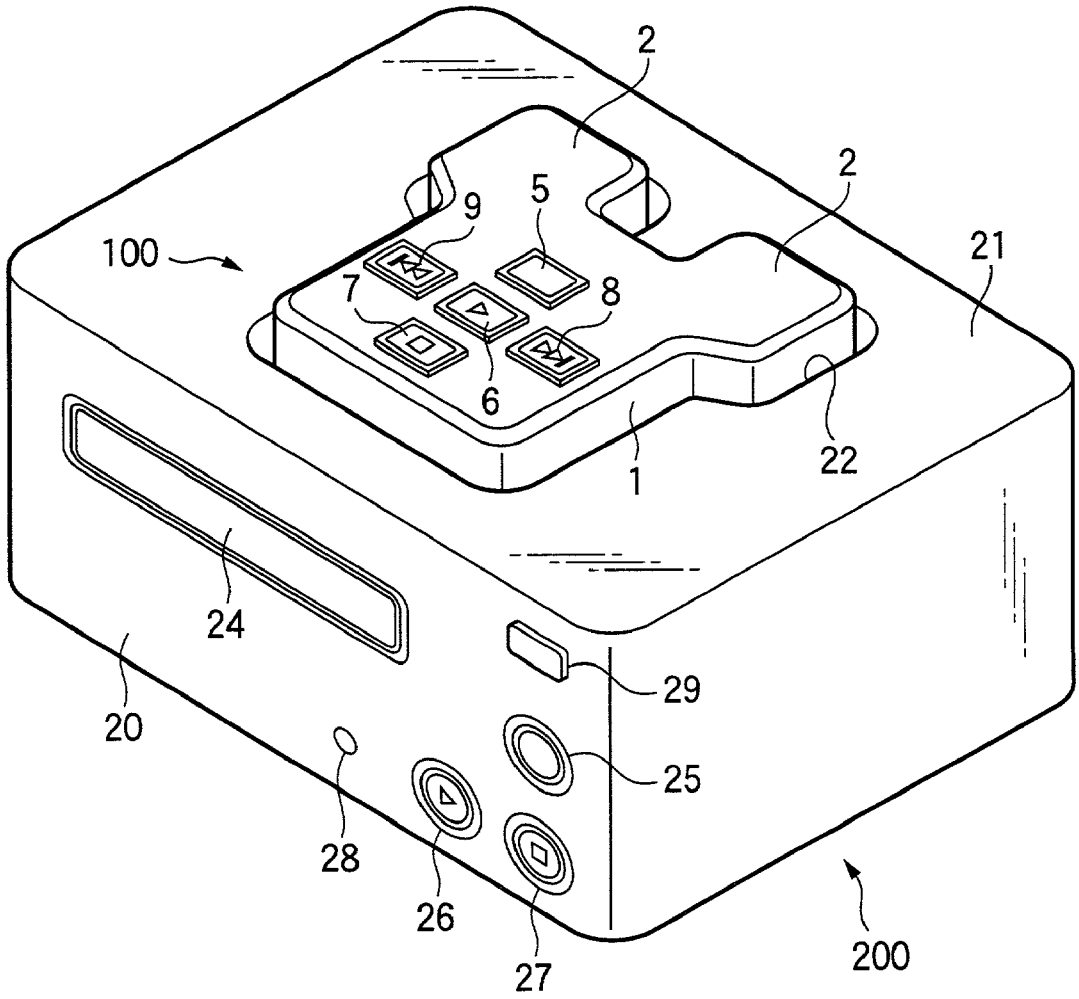
FIG. 4 is a perspective view showing the state where the first remote controller is housed in the player.

FIG. 3A is a plan view showing a state where the remote controller 100 is housed in the recess 22 of the player 200, and FIG. 3B is a front view showing the state. As shown in FIG. 3B, the depth d2 of the recess 22 is smaller than the thickness d1 of the remote controller 100. For example, d2 is about one half of d1. When the remote controller 100 is fitted into the recess 22, therefore, the remote controller 100 is housed in a state where about a half portion of the remote controller is upward protruded from the recess 22. FIG. 4 is a perspective view showing a state where the remote controller 100 is housed in the recess 22.

In the state where the remote controller 100 is housed in the recess 22 of the player 200 as described above, a magnetic attracting force acts between the magnets 3 respectively disposed in the rear faces of the projected portions 2 of the remote controller 100, and the bottom face 22*a* of the recess 22. The magnetic attracting force causes the first remote controller 100 to be attached in the projected portions 2 to the player 200. Although the top plate 21 of the player 200 is coated by the resin layer, the resin layer is thin. Therefore, the magnetic attracting force can be ensured by adequately selecting the magnetic force of the magnets 3. Alternatively, a structure may be employed in which the resin coating is omitted only in the places of the bottom face 22*a* corresponding to the magnets 3 so that the metal plate is exposed.

Figure 5:
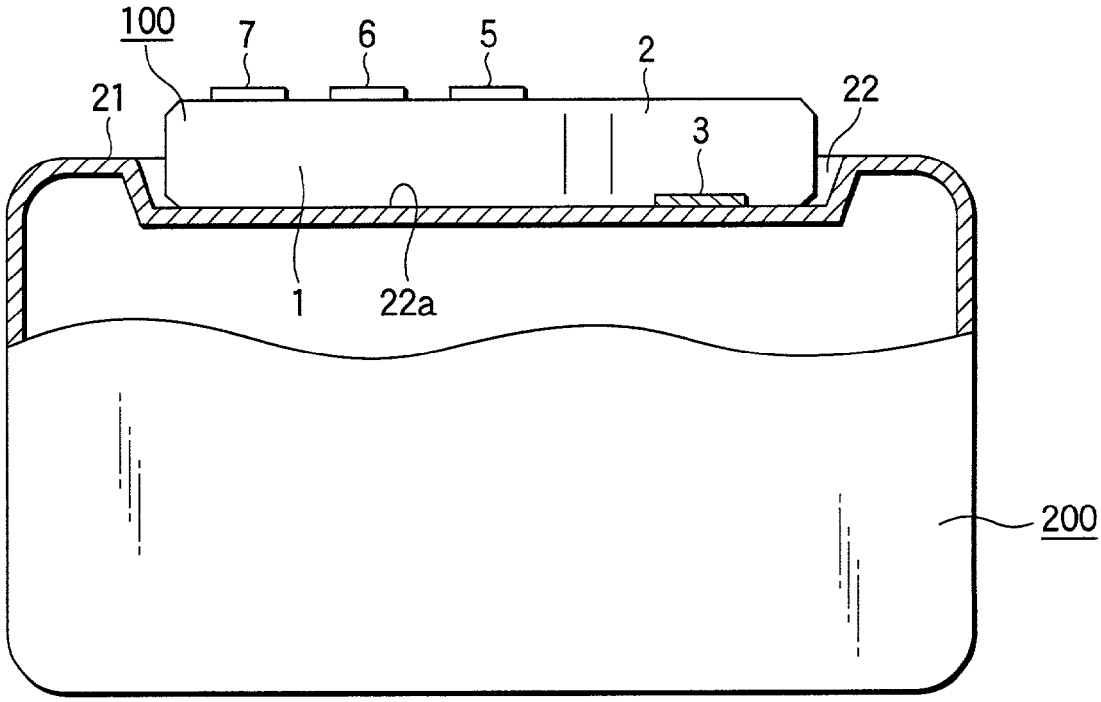
FIG. 5 is a fragmentary section view showing the state where the first remote controller is housed in the player.
Figure 6:
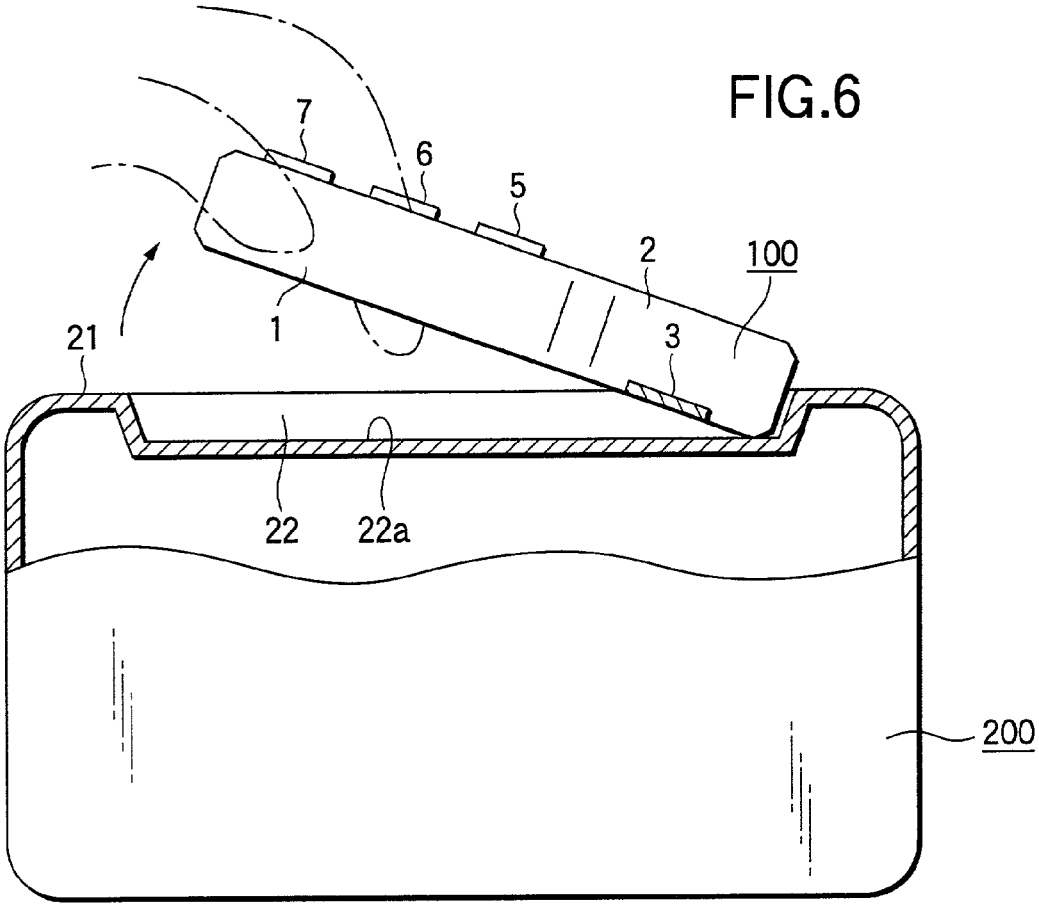
FIG. 6 is a fragmentary section view showing the manner of taking out the first remote controller.

When the remote controller 100 in the state of FIG. 5 is to be taken out, the operating portion 1 of the remote controller 100 is grasped with one hand as shown in FIG. 6, and then lifted in the direction of the arrow of the figure. The magnetic attracting force between the remote controller 100 and the player 200 acts only in the positions of the projected portions 2 on the tip end side. When the operating portion 1 which is on the side opposite to the projected portions 2 is lifted, therefore, the remote controller 100 can be easily taken out from the recess 22 by the principle of the lever even when the magnets 3 exert a large attractive force. In the embodiment, the area of the projected portions 2 is smaller than that of the operating portion 1 as described above, and hence the principle of the lever functions more effectively, so that even a child can easily take out the remote controller 100 with one hand. As shown in FIG. 3B, the depth d2 of the recess 22 is smaller than the thickness d1 of the remote controller 100, and the remote controller 100 is protruded from the recess 22, thereby enabling the operating portion 1 to be easily grasped. Therefore, the taking-out operation is performed more easily.

Figure 7:
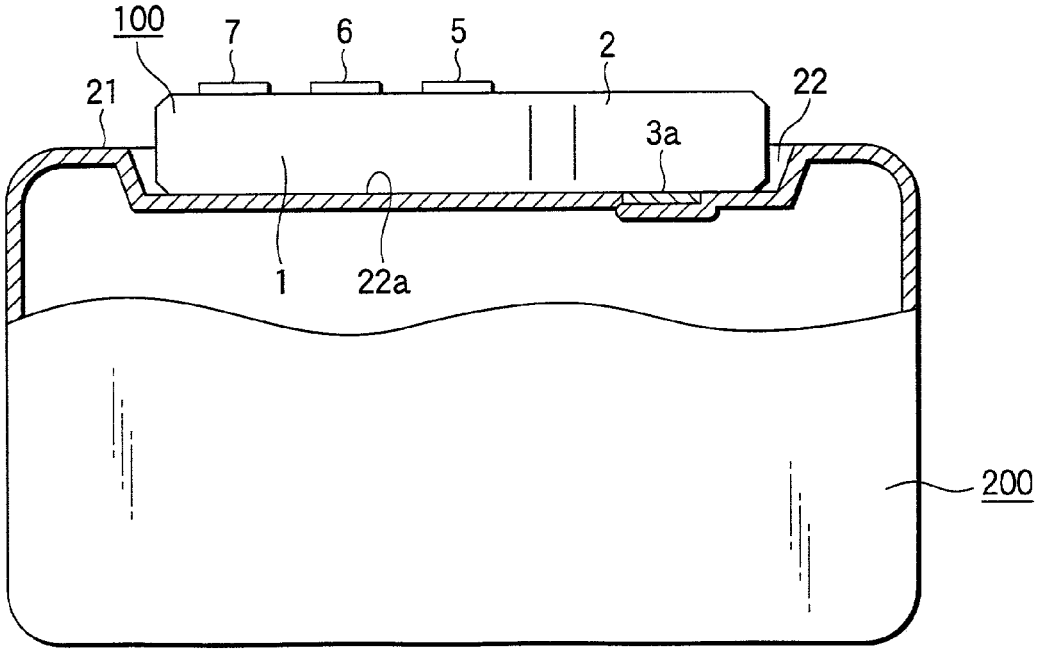
FIG. 7 is a fragmentary section view showing another embodiment of the invention.

FIG. 7 is a fragmentary section view showing another embodiment of the invention. In the embodiment, magnets 3*a* are disposed on the player 200. Specifically, the recess 22 of the player 200 has the magnets 3*a* at positions respectively corresponding to the projected portions 2 of the remote controller 100, thereby forming a structure in which the remote controller 100 is attached to the player 200 by the magnets 3*a*. A member of a ferromagnetic material (not shown) is disposed in each of the places of the remote controller 100 which are respectively opposed to the magnets 3*a*. The other components are configured in the same manner as those shown in FIG. 5, and hence denoted by the same reference numerals. Also in the embodiment of FIG. 7, the remote controller 100 can be easily taken out from the recess 22 of the player 200 by the same principle as the case of FIG. 5.

The invention can be realized in various manners in addition to the above-described embodiments. For example, the operating portion 1 of the remote controller 100 may be formed into a round shape corresponding to the face of an animal such as a dog, a cat, a bear, or a rabbit, and the pair of projected portions 2 may be formed into a shape of the ear of the animal. According to the configuration, it is possible to obtain a remote controller which has a shape of an animal, and which meets the taste of a child. In the alternative, the keys of the operating portion 1 may be arranged at positions corresponding to the eyes, the nose, the mouth, and the like so as to recall the face. In this case, greater effectiveness is exerted.

Although a DVD player is exemplrarily described as the player in the embodiments, the invention may be applied also to other kinds of players such as a CD (Compact Disk) player and an MD (Mini Disk) player. Further, the recording medium which is to be reproduced is not restricted to a disk, and may be a tape. Therefore, the invention may be applied also to a VTR (Video Tape Recorder) or the like.

In the invention, a player is provided with first and second remote controllers, the first remote controller is a simplified remote controller comprising only operating keys relating to basic functions, and the second remote controller is an ordinary remote controller. Therefore, even a child can easily operate the player by using the first remote controller. An adult can use the second remote controller so as to exert also complicated operations.

In the invention, a pair of projected portions are disposed in front of an operating portion of the first remote controller, and the remote controller is attached to the player at positions which are on one side of the remote controller. By using the principle of the lever, therefore, an operation of taking out the remote controller can be performed without applying a large force, so that even a child can easily take out the remote controller with one hand.

What is claimed is:

1. A player with a remote controller comprising:

said player having a function of reproducing a recording medium, and said remote controller that control an operation of said player, wherein said remote controller include a first and a second remote controller, said first remote controller is a simplified remote controller having:

an operating portion in which keys are arranged on a surface; and a pair of projected portions which are forward projected with being continuous to said operating portion, said keys in said operating portion including only operating keys relating to basic functions and including: a power source key for turning on/off a power source of said player; a play key for reproducing said recording medium;

a stop key for stopping an operation of reproducing said recording medium; and forward and reverse feed keys, said second remote controller comprises keys that are identical with said operating keys of said first remote controller, and various other keys, a recess, a shape of which corresponds to shapes of said operating portion and said projected portions of said first remote controller is formed in a top plate of said player, and said first remote controller housed in said recess is formed into a shape of corresponding to the face of an animal with the pair of projected portions formed into a shape of the ears of the animal, and is attached in said pair of projected portions to said player by a pair of magnets which are identical to each other are provided at said pair of projected portions, the depth of said recess is about one half of the thickness of said remote controller, and a battery is disposed between the pair of projected portions, wherein said recess has a deeper portion corresponding to said magnets.

2. A player with a remote controller comprising:

said player having a function of reproducing a recording medium, and said remote controller that control an operation of said player, wherein said remote controllers includes a first and a second remote controller, said first remote controller is a simplified remote controller including only operating keys relating to basic functions, and said first remote controller being formed into a round shape corresponding to the face of an animal, said pair of projected portions being formed into a shape of the ears of the animal, and a pair of magnets which are identical to each other are provided at said pair of projected portions, a recess in which said first controller is to be housed is formed in a top plate of said player and the first remote is attached to the player by the pair of magnets, the depth of the recess is about one half of the thickness of the remote controller, and the recess has a deeper portion corresponding to said magnets, said second remote controller includes keys that are identical with said operating keys of said first remote controller, and various other keys.

3. The player with a remote controller according to claim 2, wherein said first remote controller comprises:

an operating portion in which keys are arranged on a surface; and a pair of projected portions which are forward projected with being continuous to said operating portion, said recess of said player is formed into a shape which corresponds to shapes of said operating portion and said projected portions of said first remote controller, and said first remote controller housed in said recess is attached in said pair of projected portions to said player by magnets.

4. A simplified remote controller which is associated with a player having a function of reproducing a recording medium, and which controls an operation of said player, said remote controller comprising:

an operating portion in which keys are arranged on a surface; and a pair of projected portions which are forward projected with being continuous to said operating portion, said keys in said operating portion include only operating keys relating to basic functions, and in a state where said remote controller is housed in a recess formed in a top plate of said player, said remote controller is attached in said pair of projected portions to said player by magnets, said first remote controller being formed into a round shape corresponding to the face of an animal, said pair of projected portions being formed into a shape of the ears of the animal, and a pair of magnets which are identical to each other are provided at said pair of projected portions, wherein the depth of the recess is about one half of the thickness of the first remote controller and said recess has a deeper portion corresponding to said magnets.

5. A player, an operation of which is controlled by a first and a second remote controllers, wherein said first remote controller is a simplified remote controller which has only operating keys relating to basic functions, said first remote controller being formed into a round shape corresponding to the face of an animal, said pair of projected portions being formed into a shape of the ears of the animal, and a pair of magnets which are identical to each other are provided at said pair of projected portions, said second remote controller comprises keys that are identical with said operating keys of said first remote controller, and various other keys, and a recess in which said first remote controller is to be housed, is formed in a top plate, wherein the depth of the recess is about one half of the thickness of the remote controller and said recess has a deeper portion corresponding to said pair of magnets.

6. A player with a remote controller comprising:

said player having a function of reproducing a recording medium, and said remote controllers that control an operation of said player, wherein said remote controllers includes a first and a second remote controller, said first remote controller is a simplified remote controller having;

an operating portion in which keys are arranged on a surface; and a pair of projected portions which are forward projected with being continuous to said operating portion, said keys in said operating portion including only operating keys relating to basic functions and consisting of: a power source key for turning on/off a power source of said player; a play key for reproducing said recording medium; a stop key for stopping an operation of reproducing said recording medium; and forward and reverse feed keys, and a round shape corresponding to the face of an animal, and said pair of projected portions being formed into a shape of the ears of the animal, said second remote controller comprises keys that are identical with said basic operating keys of said first remote controller, and keys for additional functions, including a menu key, a mode key, and a zoom key, a recess a shape of which corresponds to shapes of said operating portion and said projected portions of said first remote controller is formed in a top plate of said player, and said first remote controller is housed in said recess being magnetically attached to said player by a pair of magnets which are identical to each other and which are disposed only in said pair of projected portions, wherein the depth of the recess is about one half of the thickness of the first remote controller and said recess has a deeper portion corresponding to said pair of magnets.

* * * * *